US005877129A

United States Patent [19]

Yatsuzuka et al.

[11] Patent Number: 5,877,129

[45] **Date of Patent: *Mar. 2, 1999**

[54] LUBRICANT ADDITIVE AND LUBRICATING GREASE COMPOSITION CONTAINING THE SAME

[75] Inventors: Yoshihisa Yatsuzuka; Masaru Murata; Tetsuo Tsuchiya, all of Tokyo, Japan

[73] Assignee: Showa Shell Sekiyu K.K., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 575,224

[22] Filed: Dec. 20, 1995

[30] Foreign Application Priority Data

Dec. 22, 1994 [JP] Japan ..... 6-335918
Oct. 26, 1995 [JP] Japan ..... 7-302005

[51] Int. Cl.[6] ..... C10M 125/26

[52] U.S. Cl. ..... 508/156; 508/158

[58] Field of Search ..... 252/33.6, 40.7, 252/51.5 A; 508/156, 158

[56] References Cited

U.S. PATENT DOCUMENTS

| | | | |
|---|---|---|---|
| 3,853,772 | 12/1974 | Adams | 252/18 |
| 3,929,650 | 12/1975 | King et al. | 252/33.4 |
| 3,997,454 | 12/1976 | Adams | 252/18 |
| 4,100,080 | 7/1978 | Adams | 252/18 |
| 4,155,858 | 5/1979 | Adams | 252/18 |

FOREIGN PATENT DOCUMENTS

| | | |
|---|---|---|
| 0084910 | 8/1983 | European Pat. Off. . |
| 0227182 | 7/1987 | European Pat. Off. . |

*Primary Examiner*—Margaret Medley
*Attorney, Agent, or Firm*—Sughrue, Mion, Zinn, Macpeak & Seas, PLLC

[57] ABSTRACT

A lubricant additive including a borate dispersion, wherein the lubricant additive is a dispersion of an alkali metal salt of boric acid in a mixture of an alkaline earth metal salt of a salicylic acid and an alkenylsuccinimide. The lubricant additive provides a high dropping point for grease used under a high temperature condition of 130° C. or higher and per se exhibits anti-oxidant performance. A lubricant grease composition containing the lubricating additive is also disclosed.

12 Claims, No Drawings

LUBRICANT ADDITIVE AND LUBRICATING GREASE COMPOSITION CONTAINING THE SAME

FIELD OF THE INVENTION

The present invention relates to a lubricant additive and a lubricating grease composition containing the same.

BACKGROUND OF THE INVENTION

Lithium soap grease has conventionally been used widely because of its relatively stable heat resistance and water resistance and also because most lithium soaps are easily dispersible in lubricant bases and inexpensive. However, when used in a high temperature environment of 130° C. or higher, lithium soap grease suffers deterioration in characteristics by heat, such as destruction of micelles, reduction in adhesiveness, and softening, thereby abruptly reducing its lubricating action.

Heat-resistant grease compositions compensating for the above disadvantage, such as soapless grease having an extremely high dropping point (i.e., excellent thermal stability) and complex soap grease of various types, have been developed, but they are disadvantageous in that the thickening agent used hardens or extremely softens in long-term use. Besides, they are very expensive and have therefore found limited use.

In recent years, the working environment of grease is getting severer with the size reduction of machinery and increase in speed of working parts. For example, when used for lubrication in places close to an engine heat source, as in bearings for electrical equipment in automobiles, the grease used for lubricating the bearings is exposed to a particularly high temperature for a long time. Further, constant velocity joints (CVJ), which are often used in FWD (front wheel drive) cars or 4WD (four wheel drive) cars, are used under severe conditions due to high output power and high speed of the cars and weight reduction of CVJ themselves. Such being the case, the grease to be used must have sufficient heat resistance and durability.

In appliances, small-sized bearings used in small-sized motors of air conditioners, fans, etc. and various audio parts are required to have low vibration and low noise. Hence, grease having satisfactory bearing acoustic characteristics (making no noise) as well as excellent lubricating properties are demanded.

On the other hand, with the industrial advancement, industrial machinery has been achieving high performance, getting more compact, and working under severer conditions, thus needing lubricating grease withstanding such use. The state-of-the-art load resistant grease contains a large quantity of extreme pressure additives for fulfilling various requirements under high load. However, extreme pressure additives are liable to cause environmental pollution or corrosion depending on choice. For example, of the conventional additives providing satisfactory extreme pressure properties, the use of those containing cadmium or antimony is now forbidden due to their toxicity. Further, chlorine-containing additives give corrosive influences to iron, steel, etc. particularly at 100° C. or higher.

The use of boric acid salts as grease additives for improving load resistance has been proposed in JP-A-51-33263 (the term "JP-A" as used herein means an "unexamined published Japanese patent application"), U.S. Pat. No. 3,997,454, JP-A-53-115704, JP-A-53-115705, U.S. Pat. No. 4,100,080, and JP-A-59-109595. In particular, the grease using a borate dispersion as disclosed in U.S. Pat. No. 3,997,454 is excellent. However, the borate dispersion disclosed is a dispersion of a borate in a mixture consisting of an alkali metal sulfonate or an alkaline earth metal sulfonate and an alkenylsuccinimide, and it does not per se have an anti-oxidant action.

SUMMARY OF THE INVENTION

An object of the present invention is to provide a lubricant additive comprising a novel borate dispersion, more particularly a lubricant additive comprising a novel borate dispersion which imparts a high dropping point (which is an indication of heat resistance) to grease under a high temperature working condition, especially at a temperature of 130° C. or higher, and which itself exhibits an anti-oxidant action, and to provide a lubricating grease composition containing the same.

The present invention relates to a lubricant additive comprising a borate dispersion, wherein the borate dispersion is a dispersion of an alkali metal salt of boric acid in a basic oil with an alkaline earth metal salt of a salicylic acid and an alkenylsuccinimide.

The present invention also relates to a lubricating grease composition comprising a base oil having incorporated therein (a) a thickening agent and (b) the above-mentioned specific lubricant additive.

DETAILED DESCRIPTION OF THE INVENTION

In the present invention, the term "dispersion" as used herein means a suspension obtained by dispersing solid fine particles in a liquid stably.

The alkali metal in the alkali metal borate is preferably potassium or sodium, with potassium being more preferred.

Boric acid salts have many forms, such as metaborates, triborates, tetraborates and pentaborates, and the terminology "borate" (or "boric acid salt") as used herein embraces all these forms.

The borates which can preferably be used in the present invention include those represented by the formula:

$$K_2O.xB_2O_3 \text{ or } K_2O.xB_2O_3.yH_2O$$

wherein x is a positive number of 2 to 5, preferably 2.5 to 4.5, more preferably 2.5 to 3.5, and especially 3.0; y is a positive number of 1 to 9, preferably 2 to 4.8, more preferably 2.8 to 4.4; and the number x represents a boron to potassium ratio, i.e., the number of parts of boron per part of potassium.

The alkaline earth metal salt of a salicylic acid preferably includes alkyl-substituted salicylic acid alkaline earth metal salts represented by formula (II):

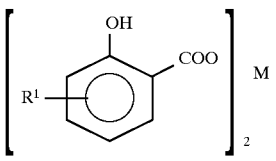

(II)

wherein $R^1$ represents an alkyl group having 8 to 22 carbon atoms; and M represents an alkaline earth metal, such as Ca, Ba and Mg (in particular, Ca and Mg contribute to a high cleaning function).

The alkaline earth metal salt represented by formula (II) can be synthesized by reacting an alkyl-substituted salicylic acid with a hydroxide of an alkaline earth metal.

The alkyl-substituted salicylic acid alkaline earth metal salts not only function as a dispersant for a borate but also exhibit an anti-oxidant action for lubricating base oils and also prevent or suppress accumulation of substances resulting from the deterioration of engine oil to function as a cleaning agent for keeping the inside of the engine clean. When applied to grease, they are effective as a thickening assistant and also make a contribution to reduction of friction.

The alkenylsuccinimide preferably includes those represented by formula (I):

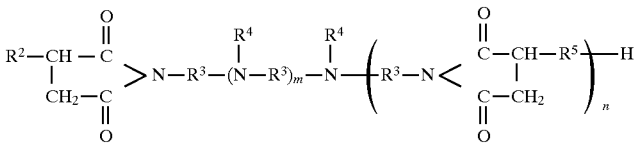

(I)

wherein $R^2$ represents a polyisobutenyl group having 30 to 200 carbon atoms; $R^3$ represents an alkylene group having 2 to 10 carbon atoms, preferably 2 to 6 carbon atoms; $R^4$ represents a hydrogen atom or an alkyl group having 1 to 6 carbon atoms; $R^5$ represents a polyisobutenyl alkylene group having 30 to 200 carbon atoms; m represents 0 or an integer of 1 to 6, preferably 0 or an integer of 1 to 3; and n represents 0 or 1, preferably 0.

The alkenylsuccinimide represented by formula (I) can be synthesized by reacting an alkenylsuccinic acid or an anhydride thereof with a polyamine.

The alkenylsuccinimide serves as a dispersant for a borate and also has the effect of dispersing sludge, which usually occurs in engine oil, in the oil.

The borate dispersion of the present invention is prepared by removing water from a water-in-oil emulsion consisting of (1) an aqueous solution containing boric acid and an alkali metal hydroxide, e.g., potassium hydroxide, and (2) an oily medium containing a salicylic acid alkaline earth metal salt and an alkenylsuccinimide. The borate dispersion itself can be considered as the lubricant additive.

The oily dispersing medium in the borate dispersion is a liquid which may have any lubricating viscosity, should be inert (particularly non-saponifying) under the reaction conditions, and has a low dielectric constant. The dispersing medium generally has a viscosity of 2 to 500 $mm^2$/sec, preferably 20 to 200 $mm^2$/sec, at 40° C.

The concentrations of the salicylic acid alkaline earth metal salt and the alkenylsuccinimide which can be used as a dispersant are subject to wide variation depending on the concentration of the borate. In general, the concentration of the former in the borate dispersion is 0.1% by weight or more, usually 0.1 to 25% by weight, preferably 1.0 to 10% by weight, and that of the latter is 0.1% by weight or more, usually 0.1 to 25% by weight, preferably 1.0 to 10% by weight. The concentration of the borate in the borate dispersion is also subject to wide variation in the range of from 5 to 80% by weight and is preferably 30 to 65% by weight.

The borate dispersion according to the present invention is extremely effective as an additive for lubricating grease and, in addition, can be used as an additive for various automobile engine oils, gear oils, industrial lubricating oils, and the like. Accordingly, the term "lubricant additive" as used herein is intended to include the additives for all these uses.

The borate dispersion is desirably used in a lubricating oil in an amount of 0.01 to 20% by weight based on the total weight of the composition.

The thickening agent which can be used in the lubricating grease composition includes lithium soaps, sodium soaps, calcium soaps, barium soaps, aluminum soaps, ureas, bentonite, and clay.

The lithium soaps are preferably selected from (1) a lithium salt of a hydroxy-fatty acid having 12 to 24 carbon atoms and (2) a mixture of a lithium salt of a hydroxy-fatty acid having 12 to 24 carbon atoms and a lithium salt of a fatty acid having 12 to 24 carbon atoms. The lithium soap is usually added in an amount of 2 to 30% by weight based on the total weight of the grease composition.

The lubricating grease composition of the present invention which uses the above-mentioned hydroxy-fatty acid lithium salt as a thickening agent particularly has a higher dropping point (230° C. or higher, preferably 250° C. or higher) as compared with conventional lithium type grease while exhibiting resistance to load and satisfactory acoustic characteristics by virtue of the synergistic effects of the hydroxy-fatty acid lithium salt and the fine and uniform borate dispersion comprised of a borate and a dispersing medium containing a salicylic acid alkaline earth metal salt and an alkenylsuccinimide.

The base oil which can be used in the composition of the present invention is selected from those conventionally used in lubricating oils, e.g., mineral oils, synthetic oils, such as synthetic hydrocarbon oils and synthetic ester oils, and mixtures thereof. The base oils used generally have a viscosity of 2 to 500 $mm^2$/sec, preferably 20 to 200 $mm^2$/sec, at 40° C.

Useful synthetic oils include α-olefin oligomers, such as an octene-1/decene-1 copolymer having a viscosity of 41.0 $mm^2$/sec at 40° C., a viscosity index of 130, a pour point of −60° C., and a flash point of 223° C.; dicarboxylic acid esters, such as di-2-ethylhexyl sebacate; and hindered ester oils, such as trimethylolpropane caprylate and pentaerythritol caproate. Other various synthetic oils, such as polyglycol oils, silicone oils, polyphenyl ether oils, halogenated hydrocarbon oils, and alkylbenzene oils, can also be used.

The hydroxy-fatty acids having 12 to 24 carbon atoms are usually straight-chain saturated or unsaturated monocarboxylic acids having a hydroxyl group in the molecule thereof. Specific examples of the hydroxy-fatty acids include ricinoleic acid, 2-hydroxydodecanoic acid, 2-hydroxytetradecanoic acid, 2-hydroxyhexadecanoic acid, ambrettolic acid, ricinostearolic acid, 9-hydroxystearic acid, 10-hydroxystearic acid, and 12-hydroxystearic acid. These hydroxy-fatty acids may be used either individually or as a mixture thereof.

The fatty acids having 12 to 24 carbon atoms are saturated or unsaturated monocarboxylic acids, such as lauric acid, myristic acid, palmitic acid, stearic acid, linoleic acid, linolenic acid, and behenic acid. These fatty acids may be used either individually or as a mixture thereof.

Of these hydroxy-fatty acids and fatty acids, those having 18 carbon atoms and those having a hydroxyl group at the 9-, 10- or 12-position are preferred. 12-Hydroxystearic acid is especially preferred.

In the formation of a lithium salt of the above-mentioned hydroxy-fatty acid or fatty acid, the hydroxy-fatty acid or fatty acid may be reacted with lithium hydroxide in the form of not only a free acid but also a glyceride thereof.

The grease composition according to the present invention is prepared by adding and dispersing the aforesaid borate dispersion in a preparation of lithium soap grease during the cooling step involved in the preparation according to known techniques. The lithium soap grease can be obtained by reacting a fatty acid or a neutral fatty oil with a lithium hydroxide in a base oil with heat stirring to produce lithium soap, heating the produced soap once again, and then dispersing it in a base oil with cooling after melting in the base oil. It is preferable for obtaining an increased dropping point to add the borate dispersion at 125° C. or higher.

The grease composition of the present invention may contain other additives generally used in grease compositions, such as extreme pressure additives, wearing agents, antioxidants, corrosion inhibitors, oiliness improvers, and the like.

EXAMPLES AND COMPARATIVE EXAMPLES

The present invention will now be illustrated with reference to Preparation Examples, Examples, and Comparative Examples, but it should be understood that the present invention is not deemed to be limited thereto. Unless otherwise indicated, all parts, percents, ratios and the like are by weight.

Preparation Example 1

Preparation of Borate Dispersion

In 400 g of water were dissolved 59.4 g of 85% pure potassium hydroxide and 166.9 g of orthoboric acid.

To 116.7 g of a purified mineral oil having a viscosity (40° C.) of 100 $mm^2$/sec were added 10.1 g of a salicylic acid calcium salt of formula (II) in which $R^1$ was an alkyl group having 14 to 18 carbon atoms and 15.5 g of polyisobutenylsuccinimide (average molecular weight: about 2000), and the resulting mixture was mixed with the above prepared solution of potassium hydroxide and orthoboric acid to prepare a suspension.

The suspension was stirred at about 100° C. to remove water by evaporation and finally heated up to 125° C., followed by cooling to obtain a potassium borate dispersion as a dark brown liquid.

Comparative Example 1

In a small open vessel which could be heated (capacity: 2,000 g) was put 860 g of a mineral oil having a viscosity (40° C.) of 100 $mm^2$/sec, and 120 g of lithium 12-hydroxystearate was added thereto as thickening agent.

The contents were heated up to 220° C. once with stirring, cooled, and then kneaded in a three-roll mill to obtain lithium soap-based grease. It is generally accepted that the above process provides satisfactory acoustic properties.

Example 1

Pale yellow grease was prepared in the same manner as in Comparative Example 1, except for adding 2.0% by weight of the potassium borate dispersion prepared in Preparation Example 1 to the mixture at 130° C. while it was being cooled.

Preparation Example 2

Preparation of Borate Dispersion

In 400 g of water were dissolved 59.4 g of 85% pure potassium hydroxide and 166.9 g of orthoboric acid.

To 85.3 g of a purified mineral oil having a viscosity (40° C.) of 100 $mm^2$/sec were added 29.7 g of a salicylate calcium salt of formula (II) in which $R^1$ was an alkyl group having 14 to 18 carbon atoms and 29.7 g of polyisobutenylsuccinimide (average molecular weight: about 2000), and the resulting mixture was mixed with the above prepared solution of potassium hydroxide and orthoboric acid to prepare a suspension.

The suspension was stirred at about 100° C. to remove water by evaporation and finally heated up to 125° C., followed by cooling to obtain a potassium borate dispersion as a dark brown liquid.

Comparative Example 2

In a small open vessel which could be heated (capacity: 2,000 g) was put 860 g of a mineral oil having a viscosity (40° C.) of 150 $mm^2$/sec, and 120 g of lithium 12-hydroxystearate was added thereto as thickening agent.

The contents were heated up to 220° C. once with stirring, cooled, and then kneaded in a three-roll mill to obtain lithium soap-based grease. It is generally accepted that the above process provides satisfactory acoustic properties.

Example 2

Pale yellow grease was prepared in the same manner as in Comparative Example 2, except for adding 2.0% by weight of the potassium borate dispersion prepared in Preparation Example 2 to the mixture at 130° C. while it was being cooled.

The effects obtained in the Examples are shown in Table 1 below in comparison with the results of the Comparative Examples. It is seen that the dropping point, which is deemed indicative of improvement of heat resistance, of the grease of Example 1 is higher than that of the grease of Comparative Example 1 by about 90° C.

Considering that the highest dropping point that has hitherto been regarded as an attainable limit is about 220° C., such a high dropping point of no lower than 250° C. as reached in Examples is a surprising result. Moreover, the grease of the Examples shows little change from Comparative Examples in terms of the 120 second value in the bearing noise test, which can be an indication of acoustic characteristics, proving that the addition of a borate caused substantially no increase in noise.

TABLE 1

| | Compara. Example 1 | Compara. Example 2 | Example 1 | Example 2 |
|---|---|---|---|---|
| Dropping point (°C.) | 187 | 189 | 267 | 264 |
| Weld load (kgf) in Shell four-ball EP test | 80 | 126 | 160 | 200 |
| Wear scar diameter (mm) in Shell four-ball wear test | 0.69 | 0.66 | 0.53 | 0.52 |
| Bearing Noise Test 120 second value | 36 | 32 | 38 | 36 |

"Dropping point" was measured by the ASTM D566-87 grease dropping point test, in which a grease sample in a prescribed container is heated in a heating bath under prescribed conditions to obtain the temperature at which the grease begins to drip from the opening of the container.

"Weld load (kgf)" in a Shell four-ball extreme pressure (EP) test was measured according to ASTM D2596-87 under the following conditions:

Number of Revolutions: 1770 rpm

Load: stepwise increased according to the standards specified in ASTM D2596-87.

TABLE 1-continued

| | Compara. Example 1 | Compara. Example 2 | Example 1 | Example 2 |
|---|---|---|---|---|

Temperature: room temperature
Time: 10 seconds
"Wear scar diameter (mm)" in a Shell four-ball wear test was measured according to ASTM D2266-91 under the following conditions:
Number of Revolutions: 1200 rpm
Load: 40 kgf
Temperature: 75° C.
Time: 1 hour
"120 Second value in bearing noise test" is a bearing noise attribute measured for each grease composition with an acoustic tester (NSK Grease Noise Tester manufactured by Nippon Seiko K.K.) in accordance with the method described in JP-B-53-2357 (the term "JP-B" as used herein means an examined Japanese Patent publication).

"Dropping point" was measured by the ASTM D566-87 grease dropping point test, in which a grease sample in a prescribed container is heated in a heating bath under prescribed conditions to obtain the temperature at which the grease begins to drip from the opening of the container.

"Weld load (kgf)" in a Shell four-ball extreme pressure (EP) test was measured according to ASTM D2596-87 under the following conditions:

Number of Revolutions: 1770 rpm

Load: stepwise increased according to the standards specified in ASTM D2596-87.

Temperature: room temperature

Time: 10 seconds

"Wear scar diameter (mm)" in a Shell four-ball wear test was measured according to ASTM D2266-91 under the following conditions:

Number of Revolutions: 1200 rpm

Load: 40 kgf

Temperature: 75° C.

Time: 1 hour

"120 Second value in bearing noise test" is a bearing noise attribute measured for each grease composition with an acoustic tester (NSK Grease Noise Tester manufactured by Nippon Seiko K.K.) in accordance with the method described in JP-B-53-2357 (the term "JP-B" as used herein means an examined Japanese Patent publication).

There are great differences in acoustic characteristics between the grease of the present invention and commercially available greases as shown in Table 2 below.

TABLE 2

| | Unworked Penetration/Worked Penetration* (25° C.) | 120 Second Value in Acoustic Test |
|---|---|---|
| Example 1 | 265/268 | 38 |
| Example 2 | 259/265 | 36 |
| Commercially available lithium grease A | 270/275 | 237 |
| Commercially available lithium EP grease B** | 280/278 | 525 |
| Commercially available lithium complex grease C | 270/279 | 1778 |

*The penetration was measured according to JIS K2220 5.3.
**The lithium EP grease contains an extreme pressure additive (SP type additive).

The embodiments of the present invention are described below.

(1) A lubricant additive comprising a borate dispersion, wherein the borate dispersion is a dispersion of an alkali metal salt of boric acid in a mixture of (1) an alkaline earth metal salt of a salicylic acid and (2) an alkenylsuccinimide.

(2) A lubricant additive comprising a borate dispersion according to (1) above, wherein the alkenylsuccinimide is a compound represented by the formula:

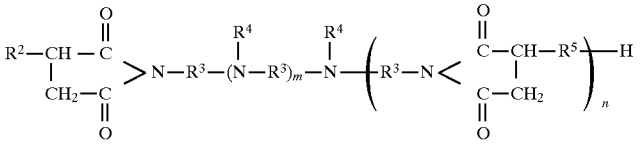

wherein $R^2$ represents a polyisobutenyl group having 30 to 200 carbon atoms; $R^3$ represents an alkylene group having 2 to 10 carbon atoms; $R^4$ represents a hydrogen atom or an alkyl group having 1 to 6 carbon atoms; $R^5$ represents a polyisobutenyl alkylene group having 30 to 200 carbon atoms; m represents 0 or an integer of 1 to 6; and n represents 0 or 1.

(3) A lubricant additive comprising a borate dispersion according to (2) above, wherein $R^2$ is a polyisobutenyl group having 30 to 200 carbon atoms; $R^3$ is an alkylene group having 2 to 6 carbon atoms; $R^4$ is a hydrogen atom or an alkyl group having 1 to 6 carbon atoms; m is 0 or an integer of 1 to 3; and n is 0.

(4) A lubricant additive comprising a borate dispersion according to (1), (2) or (3) above, wherein the alkaline earth metal salt of a salicylic acid is a compound represented by the formula:

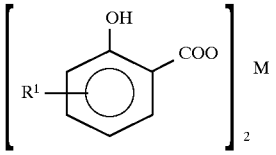

wherein $R^1$ represents an alkyl group having 8 to 22 carbon atoms; and M represents an alkaline earth metal.

(5) A lubricant additive comprising a borate dispersion according to (1), (2), (3) or (4) above, wherein the concentrations of the alkaline earth metal salt of a salicylic acid and the alkenylsuccinimide in the borate dispersion are 0.1 to 25% by weight and 0.1 to 25% by weight, respectively.

(6) A lubricant additive comprising a borate dispersion according to (5) above, wherein the concentrations of the alkaline earth metal salt of a salicylic acid and the alkenylsuccinimide in the borate dispersion are 1.0 to 10% by weight and 1.0 to 10% by weight, respectively.

(7) A lubricant additive comprising a borate dispersion according to (1), (2), (3), (4), (5) or (6) above, wherein the borate is a compound represented by the formula:

$$K_2O.xB_2O_3 \text{ or } K_2O.xB_2O_3.yH_2O$$

wherein x is a positive number of 2 to 5; y is a positive number of 1 to 9; and the number x represents a boron to potassium ratio.

(8) A lubricating grease composition comprising a base oil having incorporated therein (a) a thickening agent and (b) a lubricant additive comprising a borate dispersion according to (1), (2), (3), (4), (5), (6) or (7) above.

(9) A lubricating grease composition according to (8) above, wherein the thickening agent is selected from the group consisting of lithium soaps, sodium soaps, calcium soaps, barium soaps, aluminum soaps, ureas, bentonite and clay.

(10) A lubricating grease composition according to (8) above, wherein the thickening agent contains at least one thickening agent selected from the group consisting of (1) a lithium salt of a hydroxy-fatty acid having 12 to 24 carbon atoms and (2) a mixture of a lithium salt of a hydroxy-fatty acid having 12 to 24 carbon atoms and a lithium salt of a fatty acid having 12 to 24 carbon atoms.

(11) A lubricating grease composition according to (10) above, wherein the thickening agent is present in an amount of 2 to 30% by weight based on the total weight of the grease composition.

(12) A lubricating grease composition according to (10) or (11) above, wherein the borate dispersion is present in an amount of 0.01 to 20% by weight based on the total weight of the grease composition.

(13) A lubricating grease composition according to (12) above, wherein the concentration of a borate in the borate dispersion is 5 to 80% by weight.

(14) A lubricating grease composition according to (13) above, wherein the concentration of a borate in the borate dispersion is 30 to 65% by weight.

(15) A lubricating grease composition according to (10), (11), (12), (13) or (14) above, wherein the composition has a dropping point of not lower than 230° C.

(16) A lubricating grease composition according to (15) above, wherein the dropping point is not lower than 250° C.

The lubricant additive comprising a borate dispersion according to the present invention exhibits excellent performance in that the borate is finely dispersed in a stable state and in that the borate dispersion per se acts as an antioxidant.

Therefore, grease containing the lubricant additive of the present invention is excellent in not only heat resistance and load resistance but also acoustic characteristics.

While the grease composition according to the present invention is of the lithium soap type containing a lithium thickening agent, it is far superior to usual lithium soap grease in heat resistance and load resistance. Besides, it exhibits satisfactory acoustic characteristics equal to conventional lithium soap grease despite the addition of a borate. Thus, the grease composition of the invention is applicable to a broad range of fields demanding such high performance characteristics, including CVJ, wheel bearings and alternators in automobiles, bearings ranging from small-sized for appliances to large-sized for railway rolling stocks, and steel facilities, and it is also useful as a thread compound for drill pipes in oil wells.

While the invention has been described in detail and with reference to specific embodiments thereof, it will be apparent to one skilled in the art that various changes and modifications can be made therein without departing from the spirit and scope thereof.

What is claimed is:

1. A lubricant additive comprising a borate dispersion, wherein the borate dispersion is a dispersion of a potassium salt of boric acid in a mixture of (1) an alkaline earth metal salt of a salicylic acid and (2) an alkenylsuccinimide, wherein said alkenylsuccinimide is a compound represented by formula (I):

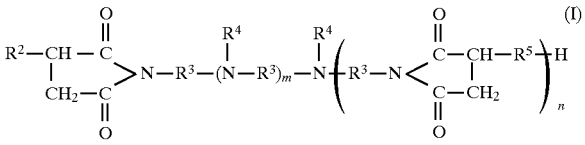

(I)

wherein $R^2$ represents a polyisobutenyl group having 30 to 200 carbon atoms; $R^3$ represents an alkylene group having 2 to 10 carbon atoms; $R^4$ represents a hydrogen atom or an alkyl group having 1 to 6 carbon atoms; $R^5$ represents a polyisobutenyl alkylene group having 30 to 200 carbon atoms; m represents 0 or an integer of 1 to 6; and n represents 0 or 1, and wherein said alkaline earth metal salt of a salicylic acid is a compound represented by formula (II):

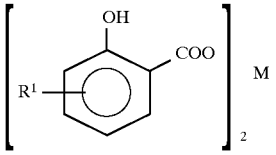

(II)

wherein $R^1$ represents an alkyl group having 8 to 22 carbon atoms; and M represents an alkaline earth metal.

2. A lubricating grease composition comprising a base oil having incorporated therein (a) a thickening agent and (b) a lubricant additive comprising a borate dispersion, wherein the borate dispersion is a dispersion of a potassium salt of boric acid in a mixture of (1) an alkaline earth metal salt of a salicylic acid and (2) an alkenylsuccinimide, wherein said alkenylsuccinimide is a compound represented by formula (I):

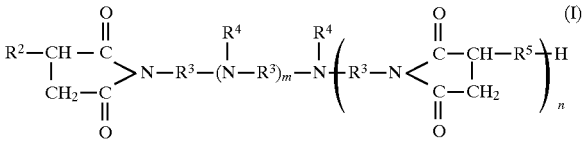

(I)

wherein $R^2$ represents a polyisobutenyl group having 30 to 200 carbon atoms; $R^3$ represents an alkylene group having 2 to 10 carbon atoms; $R_4$ represents a hydrogen atom or an alkyl group having 1 to 6 carbon atoms; $R^5$ represents a polyisobutenyl alkylene group having 30 to 200 carbon atoms; m represents 0 or an integer of 1 to 6; and n represents 0 or 1;

wherein said alkaline earth metal salt of a salicylic acid is a compound represented by formula (II):

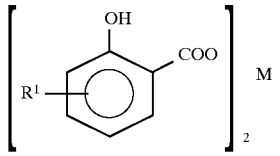

(II)

wherein $R^1$ represents an alkyl group having 8 to 22 carbon atoms; and M represents an alkaline earth metal; and wherein said thickening agent contains at least one thickening agent selected from the group consisting of (1) a lithium salt of a hydroxy-fatty acid having 12 to 24 carbon atoms and (2) a mixture of a lithium salt of a hydroxy-fatty acid having 12 to 24 carbon atoms and a lithium salt of a fatty acid having 12 to 24 carbon atoms.

3. A lubricant additive as claimed in claim 1, wherein $R^3$ represents an alkylene group having 2 to 6 carbon atoms.

4. A lubricant additive as claimed in claim 1, wherein m represents 0 or an integer of 1 to 3.

5. A lubricant additive as claimed in claim 1, wherein n represents 0.

6. A lubricant additive as claimed in claim 1, wherein the alkaline earth metal salt is a calcium salt or a magnesium salt.

7. A lubricant additive as claimed in claim 1, wherein the alkaline earth metal salt of a salicylic acid is present in the borate dispersion in a concentration of from 1.0 to 10% by weight and the alkenylsuccinimide is present in the borate dispersion in a concentration of from 1.0 to 10% by weight.

8. A lubricant additive as claimed in claim 1, wherein the potassium salt of boric acid is present in the borate dispersion in a concentration of from 30 to 65% by weight.

9. A lubricating grease composition acccording to claim 2, wherein the composition has a dropping point of not lower than 230° C.

10. A lubricating grease composition according to claim 2, wherein the composition has a dropping point of not lower than 250° C.

11. A lubricating grease composition according to claim 2, wherein the thickening agent is present in an amount of 2 to 30% by weight based on the total weight of the grease composition.

12. A process for producing a lubricating grease composition comprising a base oil having incorporated therein (a) a thickening agent and (b) a lubricant additive comprising a borate dispersion which is a dispersion of a potassium salt of boric acid in a mixture of (1) an alkaline earth metal salt of a salicylic acid and (2) an alkenylsuccinimide, wherein said alkenylsuccinimide is a compound represented by formula (I):

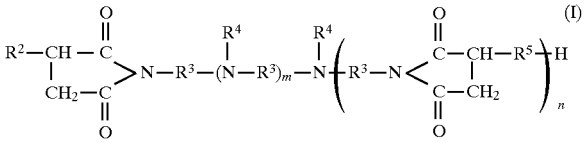

(I)

wherein $R^2$ represents a polyisobutenyl group having 30 to 200 carbon atoms: $R^3$ represents an alkylene group having 2 to 10 carbon atoms; $R^4$ represents a hydrogen atom or an alkyl group having 1 to 6 carbon atoms; R5 represents a polyisobutenyl alkylene group having 30 to 200 carbon atoms: m represents 0 or an integer of 1 to 6;and n represents 0 or 1, and wherein said alkaline earth metal salt of a salicylic acid is a compound represented by formula (II)

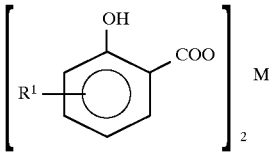

(II)

wherein $R^1$ represents an alkyl group having 8 to 22 carbon atoms;

and M represents an alkaline earth metal: said process Comprising:

adding said thickening agent to said base oil while heat stirring up to 220° C.; and dispersing said lubricant additive in said base oil during cooling at 125° C. or higher.

* * * * *